US006021713A

United States Patent [19]

Glöckner et al.

[11] Patent Number: 6,021,713

[45] Date of Patent: Feb. 8, 2000

[54] ARRANGEMENT FOR CORRECTING THE FAN-OUT EFFECT ON WEB-FED PRINTING PRESSES

[75] Inventors: Erhard Herbert Glöckner, Eibelstadt; Karl Erich Albert Schaschek, Würzburg, both of Germany

[73] Assignee: Koening & Bauer Aktiengesellschaft, Wurzburg, Germany

[21] Appl. No.: 09/284,491

[22] PCT Filed: Oct. 24, 1997

[86] PCT No.: PCT/DE97/02476

§ 371 Date: Apr. 26, 1999

§ 102(e) Date: Apr. 26, 1999

[87] PCT Pub. No.: WO98/18626

PCT Pub. Date: May 7, 1998

[30] Foreign Application Priority Data

Oct. 25, 1996 [DE] Germany ..... 196 44 391

[51] Int. Cl.[7] ..... B41M 1/14

[52] U.S. Cl. ..... 101/211; 181/220; 181/225; 181/228; 181/483; 181/484; 181/485

[58] Field of Search ..... 101/136–138, 101/180–184, 220, 221, 247, 248, 211, 225, 228, 483, 484, 485; 226/3, 15, 17, 34, 35, 95, 97, 185, 186, 190

[56] References Cited

U.S. PATENT DOCUMENTS

| | | | |
|---|---|---|---|
| 3,098,432 | 7/1963 | Bechtold et al. | 101/181 |
| 3,147,898 | 9/1964 | Huck | 226/17 |
| 3,467,008 | 9/1969 | Domotor | 101/142 |
| 3,982,327 | 9/1976 | Kurie et al. | 34/156 |
| 4,303,189 | 12/1981 | Wiley et al. | 226/17 |
| 4,696,230 | 9/1987 | Barkley . | |
| 4,831,926 | 5/1989 | Bowman et al. | 101/181 |
| 5,152,222 | 10/1992 | Okamura et al. | 101/179 |
| 5,152,522 | 10/1992 | Yamashita | 226/185 |
| 5,383,393 | 1/1995 | Ueda et al. . | |
| 5,487,335 | 1/1996 | Iijima et al. . | |
| 5,553,542 | 9/1996 | Jackson et al. . | |
| 5,598,778 | 2/1997 | Iijima et al. . | |
| 5,611,275 | 3/1997 | Iijima et al. . | |
| 5,632,201 | 5/1997 | Roch . | |

FOREIGN PATENT DOCUMENTS

| | | |
|---|---|---|
| 0 732198 A2 | 3/1996 | European Pat. Off. . |
| 4224235 A1 | 7/1993 | Germany . |
| 4327646 A1 | 4/1994 | Germany . |
| 29501373 U | 6/1995 | Germany . |

*Primary Examiner*—Kimberly L. Asher
*Attorney, Agent, or Firm*—Jones, Tullar & Cooper, P.C.

[57] ABSTRACT

The fan-out effect of a paper web, passing through a web-fed printing press having a plurality of printing units, is corrected by providing control assemblies before selected ones of the printing units. The control assemblies each have a number of control elements and counter control elements. The number of control and counter control elements in each assembly varies with the moisture content of the paper web passing through the web-fed printing press.

5 Claims, 1 Drawing Sheet

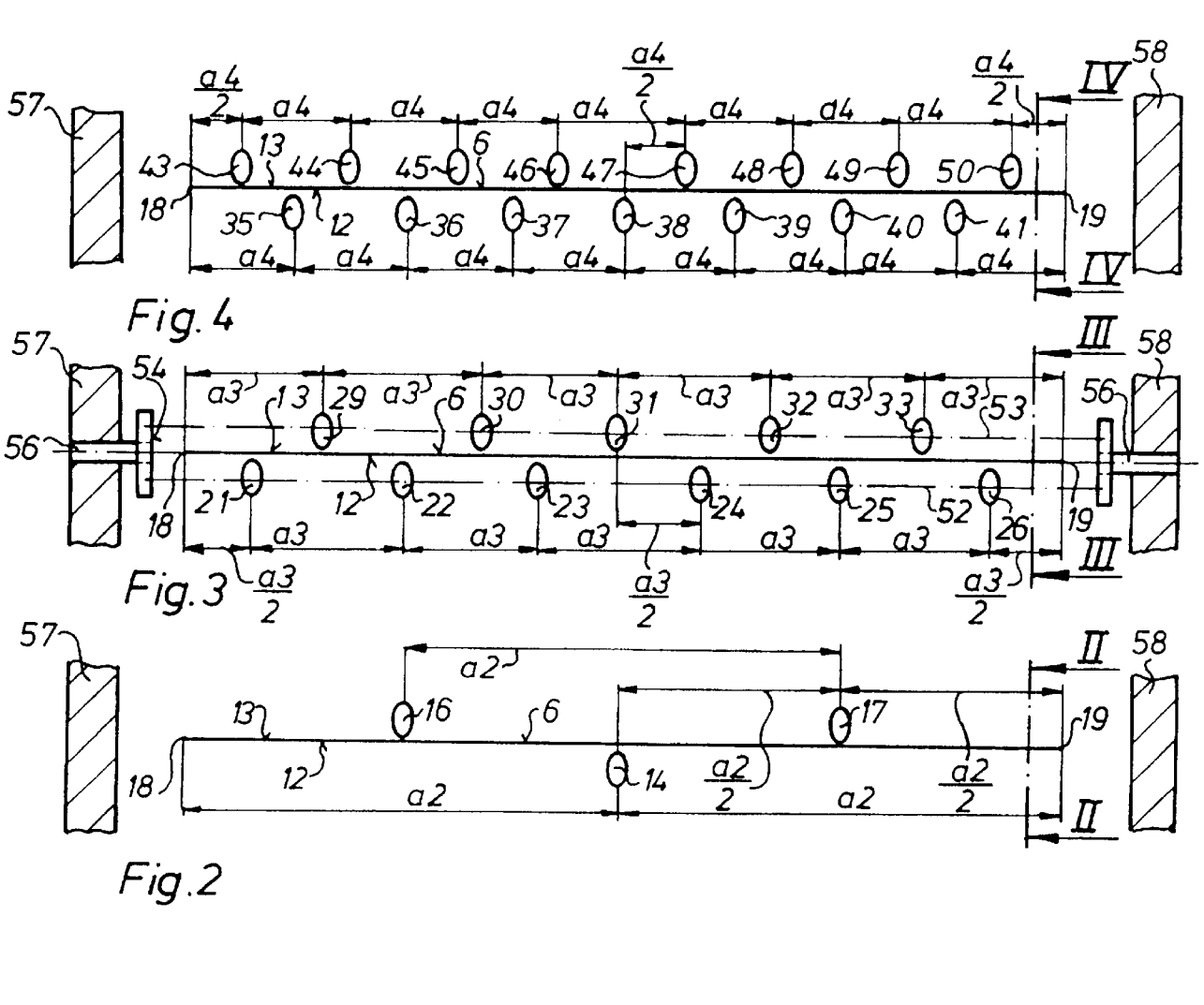
Fig. 4
Fig. 3
Fig. 2
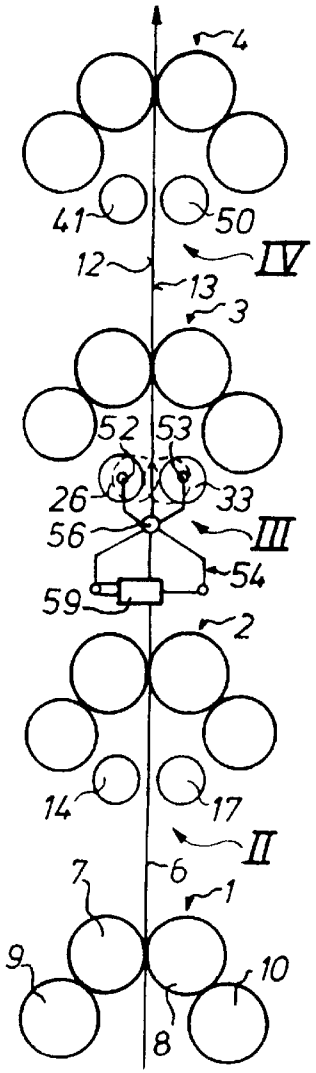
Fig. 1

ARRANGEMENT FOR CORRECTING THE FAN-OUT EFFECT ON WEB-FED PRINTING PRESSES

FIELD OF THE INVENTION

The present invention is directed to an arrangement for correcting the fan-out effect on web-fed printing presses. A variable number of control elements act on a web printed in multiple printing units. These control elements control web width.

DESCRIPTION OF THE PRIOR ART

From German Utility Model DE 295 01 373 U1, a prior art apparatus of this general type is known in which two image control rollers are disposed between the second and third double printing mechanism of a rotary printing press which has four double printing mechanisms.

These image control rollers are supported freely rotatably on pivotable levers. Downstream of the fourth double printing mechanism there is situated a reading head for scanning register marks, and which is in communication with a control device. This control device, on the basis of a set-point and actual-value comparison device, furnishes signals which are imposed on an actuating device for positioning the image control rollers.

A disadvantage of this prior art apparatus is that with a paper web of great width traveling through a web-fed rotary printing press as described above, registration errors from the fan-out effect are unavoidable.

U.S. Pat. No. 5,383,393 describing an apparatus for compensating for the fan-out effect of a paper web. In it, rollers offset from one another are disposed on both sides of the web.

SUMMARY OF THE INVENTION

The object of the present invention is to create an arrangement for correcting the fan-out effect of a web printed in a wet offset web-fed rotary printing presses.

This object is attained according to the invention by providing a plurality of spaced apart control elements which act on the web. These control elements are situated on both sides of the web across the width of the web. The control elements on one side of the web are offset laterally, or in the direction of the web width, with respect to the control element on the opposing side of the web. The number of control elements acting on the web varies as a function of the moisture content of the web.

The advantages attainable by the present invention are, in particular, that the fan-out effect can be corrected even in paper webs of relatively great width, of the kind involved in printing telephone books, for instance, where there are printing units with double printing mechanisms of the so-called "figure eight tower construction". The double printing mechanisms may also be disposed in line with one another in a vertical orientation.

It is also possible to use printing units with one printing mechanism and with various printing cylinders. That is, one printing unit can comprise two printing mechanisms arranged blanket to blanket, or can comprise one printing mechanism with a counter pressure cylinder.

Each control assembly disposed between spaced ones of the printing units is adapted to the specific moisture content found there for the moving paper web. Furthermore, even in one-sided register deviations of the web, only those control elements and counterpart control elements that are needed for correcting the width registration in the effected portion of the web can be positioned individually, or in groups to contact the paper web.

BRIEF DESCRIPTION OF THE DRAWINGS

One preferred embodiment of the present invention is shown in the drawings and will be described in further detail below.

Shown are:

FIG. 1, a schematic illustration of the printing units, with control assemblies disposed in front of each of them that are part of a "fan-out compensating device, in a position of repose seen from the front, but without side frames taken that sections II—II, III—III and IV—IV in FIGS. 2–4 respectively;

FIG. 2, a schematic view of the arrangement of control elements in front of a second printing unit of FIG. 1, in a plan view;

FIG. 3, a schematic view of the arrangement of control elements in front of a third printing unit of FIG. 1, in a plan view; and FIG. 4, a schematic view of the arrangement of control elements in front of a fourth printing unit of FIG. 1, in a plan view.

DESCRIPTION OF THE PREFERRED EMBODIMENT

A web-fed rotary printing press, for instance comprises a figure eight tower with four printing units 1; 2; 3; 4, disposed one above the other in a bridge type of construction; as seen in FIG. 1. Each of the four printing units 1–4 has two rubber blanket cylinders 7; 8 pressing against a paper web 6. Each rubber blanket cylinder 7; 8 is assigned a plate cylinder 9; 10. The plate cylinders 9; 10 cooperate with ink and damping fluid delivery devices, not specifically shown. The direction of travel or production of the web 6 leads from the printing unit 1 in the direction of the printing unit 4.

On each side 12; 13 of the two sides of the web 6, and in the production direction, a control assembly II; III; IV with a number n of control elements and a number m of counterpart control elements, spaced apart from one another, are provided in front of each printing unit 2; 3; 4. No control assembly is situated in front of the first printing unit 1.

In detail, as seen most clearly in each of FIGS. 2, 3 and 4 the arrangement can be described as follows. A control assembly II located in front of the printing unit 2 has a number n2 of control elements, for instance a single control element 14, on a first side 12 of the web 6. On the second side 13 of the web, there is a number m2 of counterpart control elements, for instance two such counterpart control elements 16; 17. The two counterpart control elements 16; 17 are spaced apart from each other, for instance, by a spacing distance a2 (where distance a2 equals half the width of the web 6 and are spaced apart from a side edge 18; 19 of the web by the spacing distance a2/2. The control element 14 is offset by a spacing a2/2 from the two counterpart control elements 16; 17, or in other words is disposed in the middle of the web 6 between the two counterpart control elements 16; 17, all as seen most clearly in FIG. 2.

The spacing distance a2, a3, a4 are each spacings from the middle or from center to center of each of the control elements.

A control assembly III located in front of the printing unit 3 is shown most clearly in FIG. 3 and has a number n3 of control elements, for instance six such control elements 21–26, on the first side 12 of the web 6. On the second side 13 of the web 6, a number m3 of counterpart control elements, such as five counterpart control elements 29–33, are disposed. The counterpart control elements 29–33 are spaced apart from one another, for instance each by the spacing a3 wherein a3 =⅙th of the width of the web 6. The control elements 21–26 are also spaced apart from one another by the spacing a3 and are offset from the counterpart control elements 29–33 by a respective spacing a3/2. There is thus a spacing of a3/2, as shown in FIG. 3 between each side edge 18 or 19 of the web 6 and the outer control element 21; 26 relative to it.

A control assembly IV is located in front of the printing unit 4, as seen in FIG. 4, and has a number n4 of control elements, for instance seven such control elements 35–41, on the first side 12 of the web 6. These control elements have a spacing a4 from one another wherein a4=one-eighth of the width of the web 6. The same spacing a4 also exists between the outer control elements 35 and 41 and the side edge 18; 19 of the web 6. A number m4 of counterpart control elements, such as eight counterpart control elements 43–50, is disposed on the second side 13 of the web 6. The counterpart control elements 43–50 likewise are spaced apart from one another by a spacing distance a4. The counterpart control elements 43–50 are offset by a spacing distance a4/2 from the control elements 35–41. The outer counterpart control elements 43 and 50 are spaced apart by the same distance a4/2 from the side edges 18; 19 of the web 6 all as seen in FIG. 4.

All the control elements and counterpart control elements in the respective control assemblies II–IV can each be embodied as control rollers and counter control rollers that are freely rotatable on respective spindles 52; 53, as depicted in FIG. 1 in association with control assembly III. The control rollers and counter control rollers are covered with ink-repellent material. For instance, the spindle 52 receives the control rollers 21–26, and the spindle 53 receives the counter control rollers 29–33. Both spindles 52; 53 are adjustable from a position of repose, shown in FIGS. 1 and 3, into a work position which is shown in dashed lines (for control assembly III in FIG. 1). In the work position, the control rollers 21–26 and the counter control rollers 29–33 act on the web 6 from both sides, so that at each point where they act, a point of crosswise shrinkage or transverse web contraction is created.

The adjustment of the spindles 52; 53 may be done synchronously, for instance by use of two scissorslike adjusting devices 54, which each comprise two double-armed levers pivotably connected to one another, and whose respective pivot axis 56 is supported in a side frame 57 and 58 of the press assembly. One pair of support arms of the work levers receives the ends of each of the spindles 52; 53, while the other pair of drive arms of the pair of work levers is connected to a respective drive mechanism. The drive mechanism may, for instance, comprise a pneumatic work cylinder 57. One such adjusting device 54 can be provided for each of the control assemblies II; III; IV on the side frames 57; 58. An actuation of the work cylinders 59 for each control assembly II; III; IV thus takes place synchronously.

With each pass of the web 6 through a printing unit 1–4, the moisture content or the moisture penetration of the web 6 increases, as is well known. As the varying number n2-n4 or m2-m4 of control elements and counterpart control elements of each control assembly II; III; IV implies, the size of the spacing or the spacing distance a2-a4 of the control elements or counterpart control elements is inversely proportional to the magnitude of the moisture content of the moving web 6. This means that the more moisture which is present in the web 6, the smaller is the spacing distance of the control elements and counterpart control elements from one another. At the same time, the number n2-n4 or m2-m4 of control elements and counterpart control elements varies in proportion to the moisture content of the web.

It is thus possible to make a differentiated correction of the fan-out effect in accordance with the moisture content of the web 6 in front of each printing unit 2; 3; 4.

The penetration depth of the control or counter control rollers into the web 6, and thus the magnitude of the crosswise shrinkage is adjustable.

A high number of rollers and counter control rollers assures an appropriate-quality printed image, even for a panorama image.

It is also advantageous that the crosswise shrinkage points made by the control and counter control rollers are not superimposed on one another, but instead are disposed side by side, because of the various different spacings a2-a4 of the control and counter control rollers. However, this is not true for the print-free gaps between the individual printing plates.

It is also possible to dimension the spacing of the control rollers and the counter control rollers using different ratio from what has been described above. In particular, the spacing of the control rollers and counter control rollers a2; a3; a4 of the control assemblies II, III, IV can be further reduced in the region of the side edge 18; 19 of the web 6. However, care must be taken that one control element, such as control element 22, is always disposed in the middle between two opposing counterpart control elements, such as 29 and 30, or conversely that one counterpart control element, such as 29, is always disposed in the middle between two opposing control elements, such as 21 and 22, as seen in FIG. 3.

During the operating state of the printing press it is assured that over the width of the web 6, action is exerted in an alternating configuration from both sides 12; 13 of web 6 by the control elements and the counterpart control elements. The web 6 then travels, as it is deformed sinusoidally over its width, as seen in cross section.

In another embodiment embodiment of the invention, it is provided that the control elements and the counterpart control elements, particularly of the control assemblies III and IV, can be adjusted from a position of repose to a work position individually or in groups. This is necessary especially whenever one-sided register deviations occur. In that case, individual or group drive mechanisms for the control and counter control rollers must be provided and which can be actuated individually from the machine control panel. It is furthermore also possible to regulate individual drive mechanisms, disposed in the control assemblies II–IV, by means of a regulating device. This regulating device is in communication with a plurality of scanner heads for scanning register marks, and furnishes signals, on the basis of a set-point and actual-value comparison, by which the aforementioned drive mechanisms are actuated.

In a further preferred embodiment of the present invention, compressed air nozzles can be used as the control elements and the counterpart control elements of the control assmblies II–IV. These air nozzles are fixedly disposed, for instance on spindles 52; 53 or on cross bars located between the side frames 57; 58. These compressed air nozzles are adjustable in terms of the force of the air pressure, so that mechanical positioning, of the kind required for the control rollers and the counter control rollers, is dispensed with.

If a web-fed rotary printing press with four printing units disposed one above the other in a figure eight tower is embodied as an H-type construction, then one control assembly is disposed between the second and third printing units. The control assembly can selectively correspond to one of the versions of the control assemblies II–IV, optionally with an individual drive.

The positioning and depositioning of the control elements 21–26; 16, 17, 43–50, that is, the variation of their respective active number and the variation in spacing to one another, can also be done automatically via an electrical control unit as a function of the applicable moisture content of the paper web 6.

While a preferred embodiment of an arrangement for correcting the fan-out effect on a web in a web-fed printing press in accordance with the present invention has been set forth fully and completely hereinabove, it will be apparent to one of skill in the art that a number of changes in, for example, the number of printing units used in the press, the width of the paper web, and the like could be made without departing from the true spirit and scope of the present invention which is accordingly to be limited only by the following claims.

What is claimed is:

1. A method for compensating for fanning out of a paper web in a web-fed printing press comprising:

providing a plurality of printing units positioned along a path of web travel in the printing press;

directing a paper web through said plurality of printing units;

increasing the moisture content of said paper web during travel of said paper web through said plurality of printing units as a result of a dampening process in each of said plurality of printing units;

providing a control assembly before an entrance to selected ones of said plurality of printing units;

providing a number of transversely spaced control elements and counter control elements in each of said control assemblies;

positioning said control elements for contact with a first side of said paper web and positioning said counter control elements for contact with a second side of said paper web and acting in gaps between said control elements; and increasing said number of said control elements and said counter control elements acting on said paper web as the moisture content of said paper web increases.

2. The method of claim 1 further including spacing said control elements and said counter control elements at a spacing distance in each said control assembly and decreasing said spacing distance from one printing unit to another printing unit in said plurality of printing units as the moisture content of the paper web increases.

3. The method of claim 1 further including supporting each said control element and said counter control element for movement into and out of contact with the paper web, and moving said control elements and said counter control elements selectively individual and in groups into contact with the paper web.

4. The method of claim 1 further including providing said control elements and said counter control elements as compressed air nozzles.

5. The method of claim 1 further including providing said control elements and said counter control elements as freely rotatable rollers.

* * * * *